US006122924A

United States Patent [19]

Lifson et al.

[11] Patent Number: 6,122,924

[45] Date of Patent: Sep. 26, 2000

[54] HOT GAS COMPRESSOR BYPASS USING OIL SEPARATOR CIRCUIT

[75] Inventors: Alexander Lifson, Manlius, N.Y.; Boris Karpman, Marlborough, Conn.

[73] Assignee: Carrier Corporation, Farmington, Conn.

[21] Appl. No.: 09/340,257

[22] Filed: Jun. 30, 1999

[51] Int. Cl.[7] ..... F25B 31/00

[52] U.S. Cl. ..... 62/192; 62/196.3; 62/470

[58] Field of Search ..... 62/192, 193, 196.1, 62/196.3, 470

[56] References Cited

U.S. PATENT DOCUMENTS

| | | | |
|---|---|---|---|
| Re. 30,869 | 2/1982 | Schibbye | 62/192 |
| 2,665,557 | 1/1954 | Dodson | 62/3 |
| 3,811,291 | 5/1974 | Schibbye | 62/84 |
| 4,180,986 | 1/1980 | Shaw | 62/192 |
| 4,275,570 | 6/1981 | Szymaszek et al. | 62/468 |
| 4,419,865 | 12/1983 | Szymaszek | 62/193 |
| 4,557,115 | 12/1985 | Nakamura | 62/156 |
| 5,134,856 | 8/1992 | Pillis et al. | 62/193 |
| 5,199,271 | 4/1993 | Ewer | 62/84 |

*Primary Examiner*—William Doerrler
*Assistant Examiner*—Marc Norman
*Attorney, Agent, or Firm*—Carlson, Gaskey & Olds

[57] ABSTRACT

Hot gas bypass of compressed fluid is accomplished using standard components of an oil separation circuit. In this method, an electronically controlled valve, which is selectively opened and closed for returning oil accumulated in the oil separator is also selectively opened when a determination is made that hot gas bypass is desired. This electronically controlled valve is placed in the oil separator return line. When the valve is opened, hot gas is bypassed from compressor outlet into compressor inlet through the oil separator.

10 Claims, 1 Drawing Sheet

HOT GAS COMPRESSOR BYPASS USING OIL SEPARATOR CIRCUIT

BACKGROUND OF THE INVENTION

The invention relates to a unique way of using an oil separator circuit to combine its function with a hot gas bypass circuit.

Hot gas bypass circuits are widely used for controlling the cooling capacity of refrigeration systems. The essence of the method is to redirect part of the compressor discharge flow as it passes through an oil separator back to the suction side to effectively reduce the evaporator capacity, without having to modulate the compressor flow.

Partial separation of oil from the oil gas mixture which leaves the compressor discharge is frequently used to minimize refrigeration system oil circulation rates. The oil separated from the discharge gas in the oil separator is directed back to the compressor suction side, while refrigerant gas with a minimal amount of oil is allowed to proceed toward the condenser. This ensures reliable compressor operation as a sufficient amount of lubricant is maintained in the compressor at all times. At the same time, the amount of oil dispersed in the system and accumulated on heat transfer surfaces of heat exchangers (such as the evaporator, condenser, economizer and suction-liquid heat exchanger, etc.) is reduced. Consequently, the overall system performance is improved.

Both hot gas bypass and oil separation circuits are often required elements of a refrigeration system. In the prior art systems, each of these circuits required separate sets of valves, connecting piping, support structure, power wiring and control hardware. Addition of the required components increased the overall system cost, complicated the geometry, and impacted serviceability. Further, the additional piping created more opportunities for refrigerant leaks. All of the above factors complicated refrigeration system design in the highly competitive and reliability sensitive air conditioning and refrigeration markets.

It is a goal of this invention to achieve a hot gas bypass operation without the necessity of including additional flow lines or valves into the refrigerant system, where an oil separator has already been installed to separate and return oil to the compressor housing.

SUMMARY OF THE INVENTION

In a disclosed embodiment, the operation of an oil separator is coupled with the operation of a hot gas bypass circuit. An electronically controlled solenoid valve and flow line that are part of the oil separation oil return system, are also used to become a part of hot gas bypass circuit. When a controller calls for initiation of hot gas bypass, it is achieved by opening the solenoid valve and bypassing vapor from the discharge line into the oil separator and then into the compressor housing via the flow line connecting system discharge and suction regions.

Thus, hot gas bypass in this method does not require any additional flow lines or valves to what is already in use for the oil separator circuit. The present invention thus provides hot gas bypass without unduly complicating the system.

These and other features of the present invention can be best understood from the following specification and drawing, the following of which is a brief description.

DETAILED DESCRIPTION OF A PREFERRED EMBODIMENT

Figure 1:
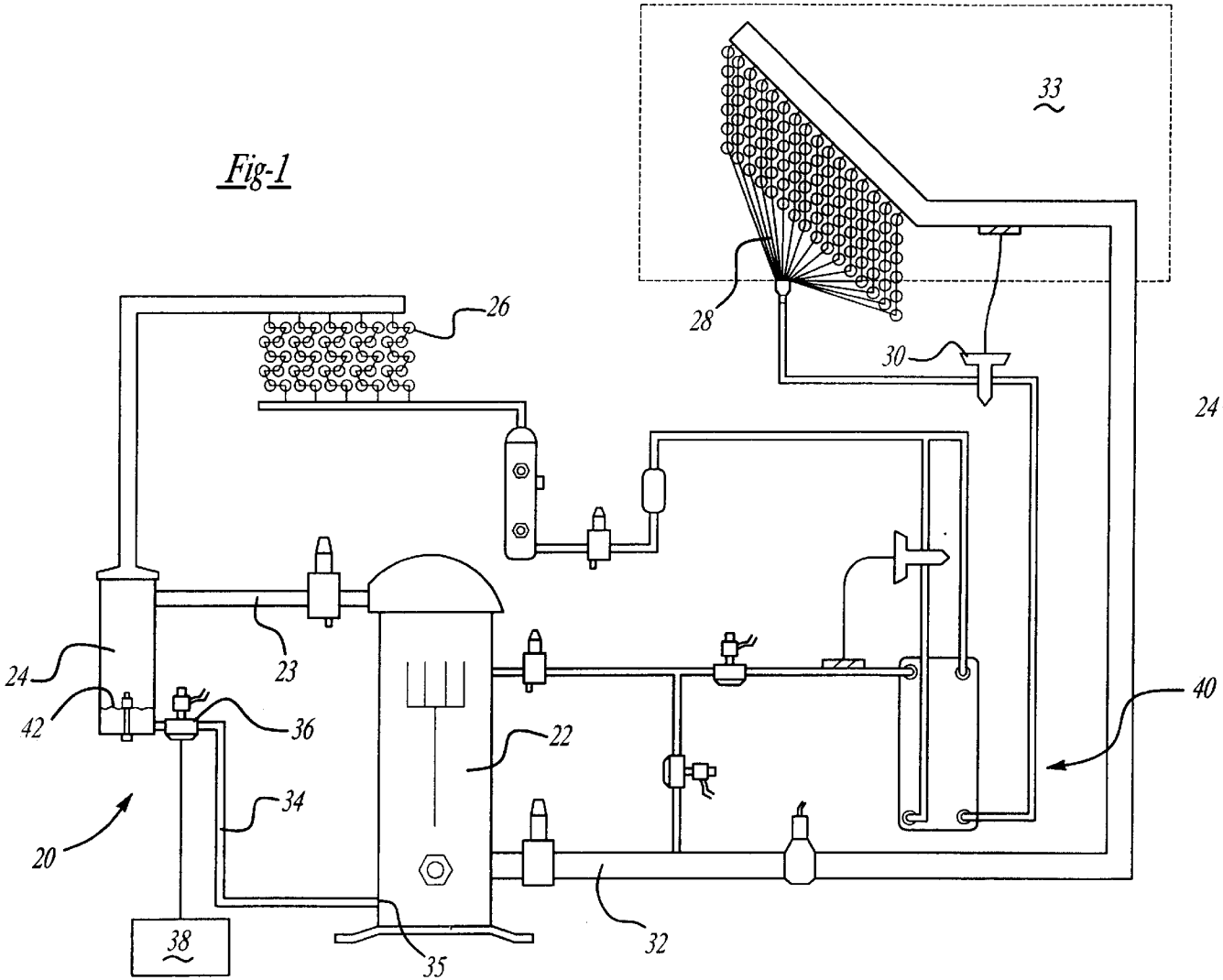
FIG. 1 is a schematic view of a refrigerant system.

FIG. 1 shows a refrigerant system 20 includes a compressor 22 having an outlet line 23 leading to an oil separator 24. The oil separator is a known component, and will not be disclosed in detail here. As known, a compressor 22 compresses the refrigerant and supplies it to a condenser 26. From the condenser 26 the refrigerant passes to an expansion valve 30 and then to an evaporator 28. From the evaporator 28, the refrigerant passes to an inlet or suction line 32, and then to the compressor 22. Of course, this is a very simplified description of the refrigeration cycle. This invention may be incorporated in conjunction with an economizer cycle and its associated heat exchanger, flow lines, expansion valves, etc. such as the system shown in the figure which is typical of transport refrigeration. Such applications frequently require hot gas bypass to maintain tight temperature control of perishable cargo at reduced system cooling requirements.

This invention applies to a variety of and compressors including for example, scroll compressors, reciprocating compressors and screw compressors.

As shown, the oil separator 24 includes a volume of oil 42 at its bottom. A return line 34 connects the oil separator 24 to a compressor housing 35. A control 38 opens and closes an electronically controlled valve 36. The electronically controlled valve 36 is placed in the line 34 to either allow or block flow between the oil separator 24 and the compressor 22. This valve is opened at predetermined intervals to allow oil accumulated in the oil separator to return back to the compressor housing. As known, modern refrigeration cycles have electronic controls that control the operation of several system components. The control 38 may be one of those types which is further programmed to control the operation of the valve 36.

The valve 36 may be a solenoid valve which has open and closed position. In addition to controlling the oil return back to compressor housing, the control 38 also has built-in algorithm to recognize when hot gas bypass from the discharge line 23 back to the inlet of compressor 22 is desirable. This application does not extend to determining times when such bypass would be desirable. It is known within the refrigerant art that under certain operating conditions hot gas bypass is desirable, and the compressor control 38 would be programmed to recognize such occurrences.

At such times the control 38 opens the solenoid valve 36 to allow gas to be bypassed from the discharge line 23 and to flow through the oil separator 24 and then to the compressor 22. When it is determined that bypass is no longer desirable, the control 38 again closes the valve 36. Also, if a predetermined amount of oil has accumulated in the oil separator 24, the valve 36 may also be opened to return the oil back to the compressor housing.

Figure 2:
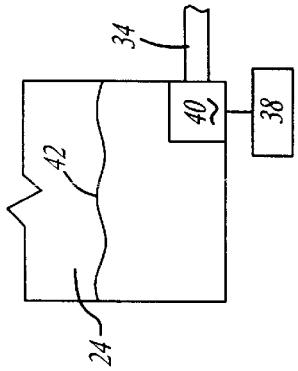
FIG. 2 shows an alternative valve.

FIG. 2 shows an alternative wherein the valve 40, shown schematically, is mounted within separator 24. For purposes of this application, the term mounted in or on the return line refers to either the FIG. 1 or FIG. 2 position.

With the present invention, a bypass of compressed gas to the compressor housing is achieved without any additional flow lines, components or additional structure, except what has already been required for an oil separation circuit. Stated another way, the existing components of the oil separator circuit are utilized to achieve the hot gas bypass.

Although a preferred embodiment of this invention has been disclosed, a worker in this art would recognize that certain modifications would come within the scope of this invention. For that reason, the following claims should be studied to determine the true scope and content of this invention.

What is claimed is:

1. A method of operating a refrigeration cycle comprising the steps of:

(1) providing a compressor having a suction inlet for receiving a refrigerant to be compressed and an outlet for delivering a compressed refrigerant to a downstream destination, providing an oil separator communicating with said outlet, and being operable to separate oil from compressed refrigerant, and providing a return line from said oil separator back to said compressor to return a separated oil;

(2) providing a controllable valve for selectively blocking or allowing flow through said return line between said oil separator and said compressor, and (3) allowing refrigerant flow through said oil separator back to said compressor when a determination is made that it would be desirable to bypass compressed refrigerant from said outlet back to said compressor.

2. A method as recited in claim 1, wherein a controller operates an electronically controlled valve on said return line to achieve the selected blocking or allowing of flow through said return line, and said electronically controlled valve being opened when said determination is made that bypass is desirable.

3. A refrigeration system comprising:

a compressor having a refrigerant suction line and a refrigerant outlet and a compressor unit for compressing a refrigerant;

an oil separator communicating with said outlet, said oil separator being operable to separate oil from said refrigerant in said outlet;

an oil return line for returning oil from said oil separator to said compressor; and a valve mounted on said oil return line, and a control for operating said valve, said control opening said valve when a determination is made that a bypass of refrigerant from said outlet to said compressor is desirable.

4. A system as recited in claim 3, wherein said valve is an electronically controlled valve.

5. A system as recited in claim 4, wherein said electronically controlled valve is a solenoid valve.

6. A system as recited in claim 3, wherein said compressor is a scroll compressor.

7. A system as recited in claim 3, wherein said system is part of a refrigeration transport system.

8. A refrigeration system comprising:

a refrigerant transport system including a container to be cooled;

a compressor having a refrigerant suction line and a refrigerant outlet and a compressor unit for compressing a refrigerant;

an oil separator communicating with said compressor outlet, said oil separator being operable to separate oil from said refrigerant in said compressor outlet;

an oil return line for returning oil from said oil separator to said compressor; and an electronically controlled valve mounted on said oil return line, and a control for operating said valve, said control opening said valve when a determination is made that a bypass of refrigerant from said outlet to said suction is desirable.

9. A refrigeration system as recited in claim 8, wherein said valve also opens to allow oil to flow from said oil separator to said compressor.

10. A refrigeration system as recited in claim 8, wherein said valve is mounted on said return line and in said oil separator.

* * * * *